United States Patent [19]

Dinger

[11] Patent Number: 4,947,997

[45] Date of Patent: Aug. 14, 1990

[54] HANGER FOR POOL CUES

[76] Inventor: Fred C. Dinger, 12147 E. Lakeland, Sp. #75, Santa Fe Springs, Calif. 90670

[21] Appl. No.: 330,794

[22] Filed: Mar. 30, 1989

[51] Int. Cl.[5] ..... A47F 7/00

[52] U.S. Cl. ..... 211/68; 211/113

[58] Field of Search ..... 211/68, 60.1, 113, 118, 211/13; 248/222.2, 222.3, 224.4

[56] References Cited

U.S. PATENT DOCUMENTS

| | | | |
|---|---|---|---|
| 2,279,237 | 4/1942 | Kellems et al. | 248/317 |
| 2,613,079 | 10/1952 | Reynolds | 211/68 X |
| 2,987,289 | 6/1961 | Wamsley | 248/222.3 X |
| 3,194,405 | 7/1965 | Hawie | 248/222.3 X |
| 3,236,388 | 2/1966 | Ruettger | 211/113 |
| 4,079,839 | 3/1978 | Winfree, Jr. | 211/68 |

*Primary Examiner*—Alvin Chin-Shue
*Assistant Examiner*—Sarah H. Lechok
*Attorney, Agent, or Firm*—Edgar W. Averill, Jr.

[57] ABSTRACT

A hanger for pool cues, billiard cues and the like which is insertable and removable from a rack. The hanger has an elongated cue holding portion with a pocket at the bottom and a removable strap near the top. The hanger member fits into a slot and, preferably, is a T-shaped hanger member, and a turnable disk may be positioned behind the slot.

7 Claims, 1 Drawing Sheet

HANGER FOR POOL CUES

BACKGROUND OF THE DISCLOSURE

The field of the invention is sporting goods, and the invention relates more particularly to apparatus used in conjunction with the sport of pool or billiards. While racks for pool cues are common in establishments which have pool tables, such racks are not ideal for persons who have their own pool cue. By placing a personal pool cue temporarily on a public rack, the owner runs the risk that someone else will inadvertently take the pool cue from the rack and use and possibly damage it. Since high quality pool cues now average about $250 per cue, it is risky to stand them in the corner or against a wall because of the possibility of breakage. Although cases have been devised which hold pool cues, these are not conveniently stored between games.

SUMMARY OF THE INVENTION

It is, thus, an object of the present invention to provide a hanger for pool cues which is capable of individualizing the hanger into different units which are readily distinguishable by others.

The present invention is for a hanger for pool cues, billiard cues and the like, said hanger being insertable and removable from a rack. The hanger has an elongated cue holding portion including a top and a bottom and has a pocket at the bottom and a holding member near the top. A hook member is affixed at the top which permits the hanger to be held in a rack. Preferably, the hanger is a T-shaped hanger having a vertical rod affixed to the holding portion and a horizontal T-shaped member which may be inserted into a slot in a rack. Preferably, the rack has a plurality of slots, and each slot has a turnable disk behind it. In this way, the horizontal portion of the T-shaped hook member may be inserted through the slot and into a recess in the disk. Thereafter, the hanger may be turned, thereby turning the disk and securely holding the hanger in the rack. The rack should be mountable on a vertical wall, and the portion of the rack which includes the slots may be either vertical or at an angle from the horizontal. The holding member is advantageously secured by hook and eye material of the type commonly sold under the trademark "Velcro" and may be decorated with the owner's name or initial.

DESCRIPTION OF THE PREFERRED EMBODIMENTS

Figure 1:
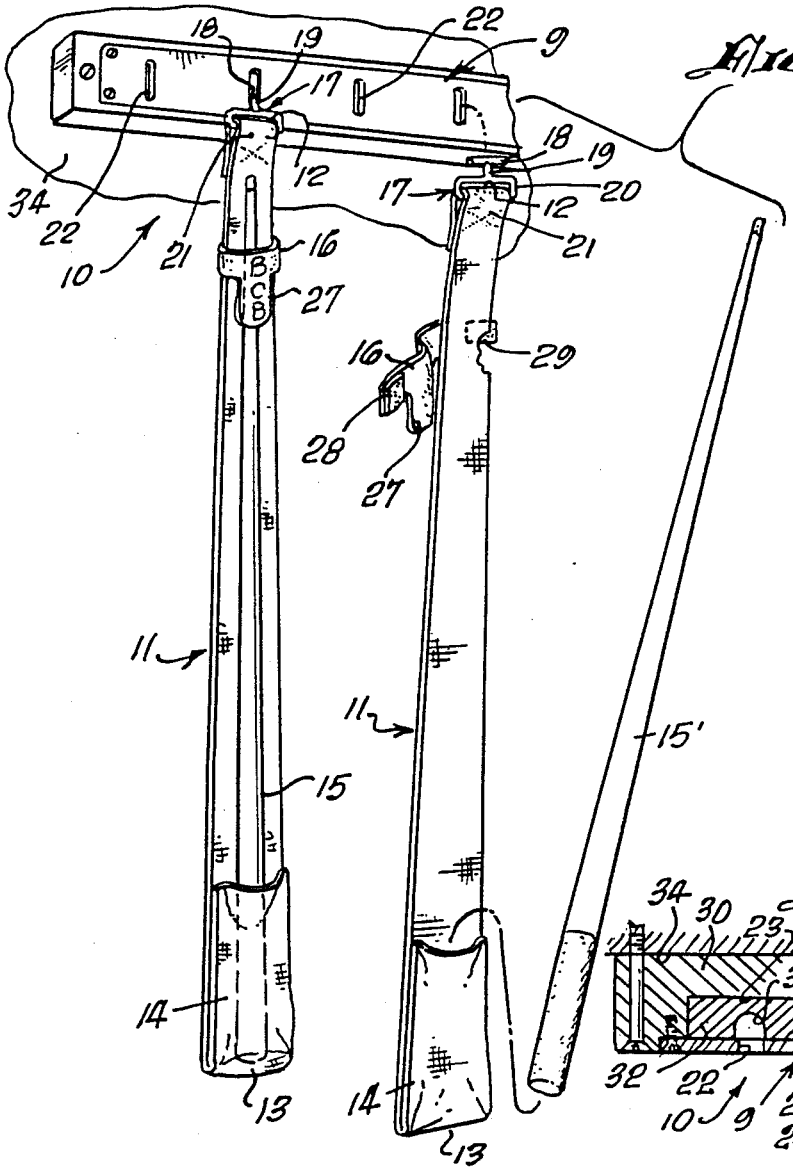
FIG. 1 is a perspective view of the hanger for pool cues of the present invention showing a pool cue being held and one that has been just removed.
Figure 4:
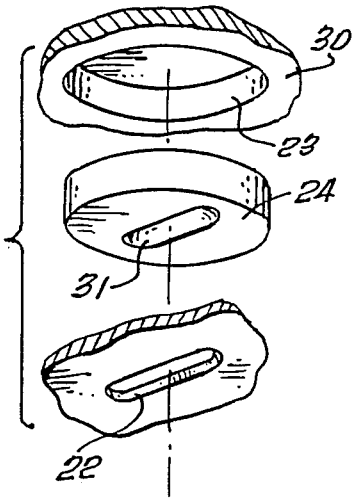
FIG. 4 is an exploded, perspective view of the slotted member, disk and recess of the rack of the hanger of FIG. 1.
Figure 2:
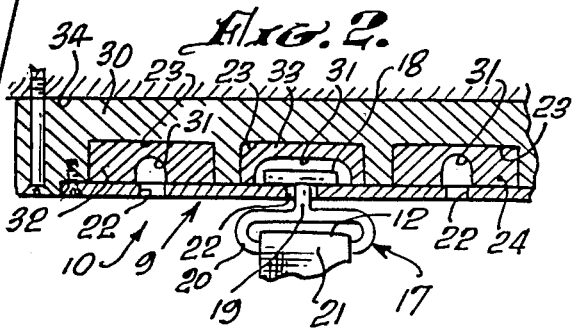
FIG. 2 is a cross-sectional view of the hook portion and rack of the hanger of FIG. 1.
Figure 3:
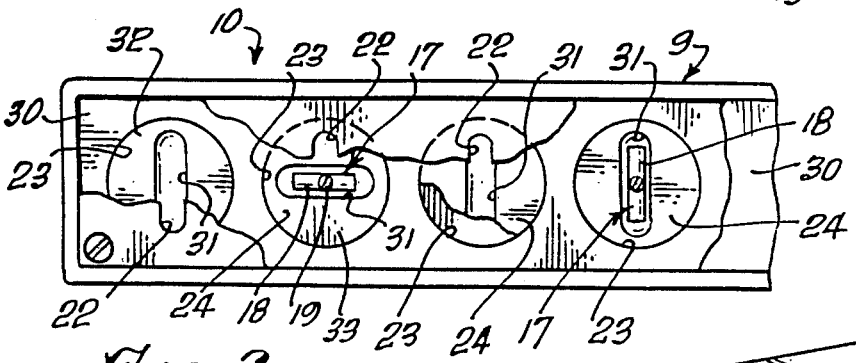
FIG. 3 is a front view of the rack of the hanger of FIG. 1.
Figure 5:
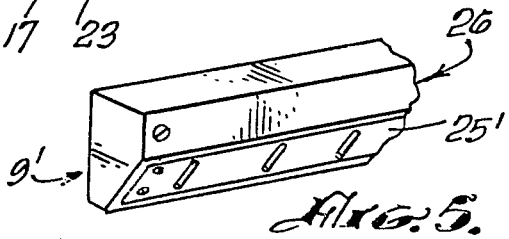
FIG. 5 is a perspective view of a portion of an alternate configuration of rack for use with the hanger of FIG. 1.

A hanger for pool cues, billiard cues and the like is shown in perspective view in FIG. 1 and indicated by reference character 10. The hanger consists of a rack member 9 and an elongated cue holding portion 11. Cue holding portion 11 has a top 12 and a bottom 13 which includes a pocket 14 which holds the handle of cue 15. A holding member or strap 16 is secured to the cue holding portion near the top thereof. Strap 16 includes a flap 27 which may include indicia indicating the owner. Preferably, the strap is easily affixed and removed, and a hook portion 28 and a pile portion 29 are shown in FIG. 1 of the type commonly sold under the trademark "Velcro." At the top 12 of the cue holding portion 11, a T-shaped hook member 17 is located. This includes a horizontal, holdable rod 18 and a vertical rod 19 connected to a hook loop 20. Hook loop 20 is sewn into a loop 21 at the top of the cue holding portion. Although, rod 18 may be simply inserted into a slot 22, which has a recess behind it, and turned, it is more securely held by the provision of a disk 24 held in a circular recess 23 formed in the base 30 of rack 9. The rod 18 is, thus, inserted through slot 22 in slot plate 25 into recess 31 in disk 24. This is done when disk 24 is in the position indicated by reference character 32 in FIG. 2. The loop 20 is then turned 90°, as shown by the disposition indicated by reference character 33 in FIG. 2, which thus securely holds the T-shaped hook member 17 in the rack 9. A plurality of slots are preferably provided in rack 9 so that a plurality of pool cues may be held therein. The rack is preferably designed so that it may be mounted on a wall 34 with the slot plate 25 either vertical, as shown in FIG. 1, or at an angle such as the 45° angle shown in FIG. 5. In FIG. 5, slot plate 25', is affixed over a recessed area in base 26 of rack 9'. In this way, it can be installed at a desired height and easily used.

The rack is advantageously made of high quality material such as brass or stainless steel. Slot plate 25 is held in an oak or maple base 30. The disk 24 is preferably made from aluminum, although it could also be made from hardwood or other durable material. The hook loop 20 preferably is about one and one-half inches wide, and the horizontal, holdable rod is advantageously between one-half to three-eighths inch wide fitting into a disk between seven-eighths and one and one-quarter inches diameter.

The hanger of the present invention is most useful for the players of a team and eliminates any confusion as to the ownership of the cue.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A hanger for pool cues, billiard cues and the like, said hanger being insertable and removable from a rack, said hanger comprising:

an elongated, cue holding portion having a top and a bottom and including a pocket at the bottom and a holding member near the top;

a hook member affixed at the top thereof for insertion into a rack member, said hook member comprising a T-shaped member having a vertical rod and a horizontal holdable rod; and a rack member having a plurality of slots therein matable with said hook member, said slots being longer than the length of said horizontal holdable rod, and said slots having an opening therebehind so that one of said horizontal holdable rods may be inserted through a slot and turned to be securely held thereby and wherein the horizontal holdable rod may also be turned freely so that it may be removed from the slot.

2. The hanger for pool cues of claim 1 wherein said plurality of slots is formed in a plate affixed to a block, which block has a recessed area behind each slot.

3. The hanger for pool cues of claim 4 wherein said recessed area includes a plurality of circular recesses, one behind each slot in said plate and wherein a disk with a recess, which generally matches the slot behind which it is mounted, is held in each circular recess, whereby said T-shaped member of one of the hook members may be inserted through a slot and into a recess of one of the disks and the hook and disk turned so that the T-shaped rod is securely held behind the slot in said plate and yet can be easily removed by turning the T-shaped member to align it with the slot in the plate.

4. The hanger for pool cues of claim 3 wherein said plate is elongated and mounted horizontally with its face in a vertical orientation.

5. The hanger for pool cues of claim 3 wherein said plate is elongated and mounted at about a 45° angle with respect to the vertical.

6. The hanger for pool cues of claim 3 wherein the holding member is removably secured about a cue placed in said hanger.

7. The hanger for pool cues of claim 6 wherein said holding member has a hook and eye attachment to said cue holding portion.

* * * * *